United States Patent [19]

Ponghis et al.

[11] 4,363,656

[45] Dec. 14, 1982

[54] INJECTION OF HOT GASES INTO SHAFT FURNACE

[75] Inventors: Nikolas Ponghis, Neuville-en-Condroz; Jean-Marie Masuy, Jemeppe sur Meuse, both of Belgium

[73] Assignees: Centre de Recherches Metallurgiques-Centrum Voor Research in de Metallurgie, Brussels; Societe Anonyme Cockerill, Seraing, both of Belgium

[21] Appl. No.: 215,076

[22] Filed: Dec. 10, 1980

[30] Foreign Application Priority Data

Dec. 10, 1979 [LU] Luxembourg ..... 81976

[51] Int. Cl.[3] ..... F27B 1/16

[52] U.S. Cl. ..... 75/42; 266/138; 266/267; 373/18; 373/24

[58] Field of Search ..... 266/138, 188, 267; 75/42; 13/2 P; 315/111.2; 373/18, 24

[56] References Cited

U.S. PATENT DOCUMENTS 3,644,782 2/1972 Sheer et al. ..... 315/111.21

3,970,290 7/1976 Santen et al. ..... 266/267 X

*Primary Examiner*—G. O. Peters

*Attorney, Agent, or Firm*—Holman & Stern

[57] ABSTRACT

A tuyere for injecting hot reducing gases into a furnace is provided with an inlet pipe and a plasma oven whose gas outlet axis is inclined to the longitudinal axis of the tuyere. The angles which the outlet axis of the plasma oven and the inlet pipe form with the said longitudinal axis are such that the longitudinal axis is parallel to the vector sum of the amount of movement of the gases from the plasma oven and the inlet pipe respectively .

4 Claims, 1 Drawing Figure

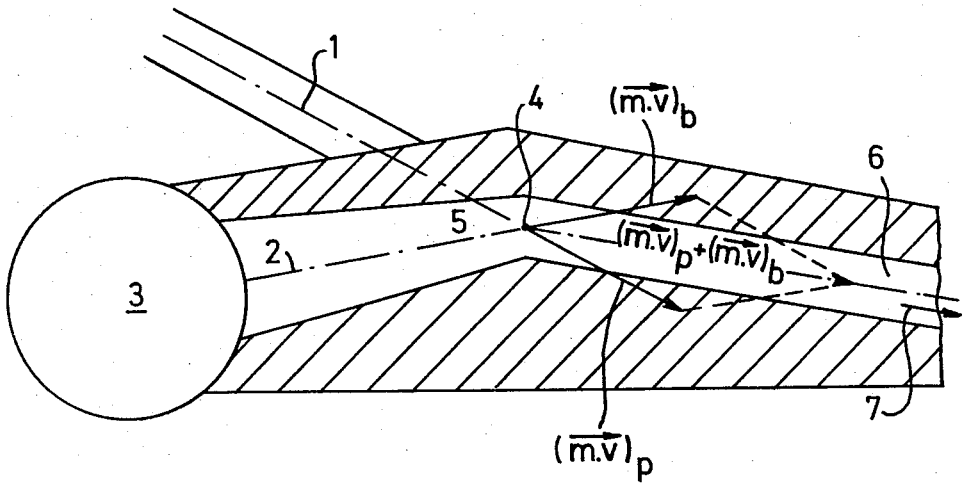
1
4
$(\overrightarrow{m.v})_b$
6
5
2
$(\overrightarrow{m.v})_p+(\overrightarrow{m.v})_b$
3
7
$(\overrightarrow{m.v})_p$

INJECTION OF HOT GASES INTO SHAFT FURNACE

FIELD OF THE INVENTION

This invention relates to a method and device for injecting hot gases into a shaft furnace and in particular into the hearth of a blast furnace, preferably at the level of the main tuyeres.

BACKGROUND OF THE INVENTION

It is known to dispense with the need for a considerable portion of the coke of the charge of a blast furnace by the replacement of the hot air blasted into the main tuyeres by a certain amount of hot reducing gases. These reducing gases are injected at a high temperature and contain chiefly CO and $H_2$.

A method of this type is in particular advocated in order to reduce coke consumption, coke being a fuel which is costly and in relatively short supply. It is even possible to envisage all the heat and reducing gas requirements being covered by this method. In this case, in addition to its metal carburizing function, the coke would then only have the role of a refractory mechanical support which supports the solid charge and enables the decanting of the reduced metal and the slag.

There are at present several methods of manufacturing reducing gases, for example the method using partial oxidation under steam or the method using partial oxidation with oxygen, applied to gaseous or liquid hydrocarbons.

In an attempt to diversify the energy sources used in the iron and steel industry, the applicants have also previously advocated the production of reducing gases from a gaseous or liquid hydrocarbon or from a carbonaceous solid material, suh as coal, using the throat gas as the oxidising agent.

In all cases, the reducing gases obtained are heated to a temperature of between 1700° C. and 2500° C. in order to be injected into the hearth of the blast furnace. High temperatures may be obtained in several ways, but excellent results have been obtained according to a method advocated elsewhere by the applicants by heating these gases in a plasma medium (GB patent specification No. 1 488 976). Within the scope of this method, the applicants suggested in particular to provide the inlet pipe adjacent to the main tuyere with a plasma oven, preferably cylindrical, whose gas outlet axis was oblique to the longitudinal axis of the tuyere. An arrangement of this type raises, however, the problem of the suitable orientation of the gas outlet axes of the inlet pipe and the plasma oven to ensure that the resultant mixture is directed along the longitudinal axis of the tuyere and thus to prevent the gases from striking the internal refractory covering of the tuyere.

SUMMARY OF THE INVENTION

The present invention provides a method of injecting hot reducing gases into a shaft furnace, in particular into the hearth of a blast furnace, preferably at the level of the main tuyeres, in which the inlet pipe adjacent to each tuyere is provided with a plasma oven whose gas outlet axis is oblique to the longitudinal axis of the tuyere, and the angles formed by the plasma oven and inlet pipe axes with the longitudinal axis of the tuyere are determined on the basis of a parallelism between the longitudinal axis of the tuyere and the vector representing the sum of the vectors of the amount of movement of the gases being discharged from the plasma oven and the inlet pipe respectively, $(\overrightarrow{m.v})_p+(\overrightarrow{m.v})_b$.

The amount of movement of a gaseous jet of mass flow m and speed v is equal to m.v.

The present invention also relates to a device for carrying out the method described above.

The device of the present invention for injecting hot reducing gases into a shaft furnace and in particular into the hearth of a blast furnace, preferably at the level of the main tuyeres, in which the inlet pipe adjacent to each tuyere is provided with a plasma oven whose gas outlet axis is oblique to the longitudinal axis of the tuyere, is essentially characterised in that from the point of intersection of the above-mentioned axes, the portion of the longitudinal axis of the tuyere located downstream of this point in the direction of flow of the gases towards the aperture for injection into the furnace forms an angle with the upstream portion such that the direction of this downstream portion corresponds to that of the resultant of the vectors of the amount of movement of the gases being discharged from the plasma oven and the inlet pipe respectively.

BRIEF DESCRIPTION OF THE DRAWING

The accompanying drawing shows a structural embodiment of a device of the invention.

The gas outlet axis of the plasma oven is shown at 1 and that of the inlet pipe at 2, this nozzle being supplied by a pipe 3 encircling the blast furnace. The above-mentioned axis 1, 2 meet at a point 4 located on the longitudinal axis of the tuyere for injecting the reducing gases into the furnace. This longitudinal axis has a change of direction at point 4: the upstream portion 5 is located in the projected extension of the axis 2 of the inlet pipe and the downstream portion 6 in the direction of the flow of the gases towards the furnace (arrow 7) forms an angle with the upstream portion such that the direction of this downstream portion corresponds to that of the resultant of the vectors of the amount of movement of the gases being discharged from the plasma oven $(\overrightarrow{m.v})_p$ and the inlet pipe $(\overrightarrow{m.v})_b$.

The gases blown in through the plasma oven and the inlet pipe are selected according to the mode of operation of the section of the blast furnace into which the gases are to be injected. By way of example, the plasma oven may be supplied with reducing gas or with a mixture of hydrocarbonaceous fuel (liquid or gaseous) and an oxidant (liquid, gaseous, or solid), in order to produce at the outlet of the plasma oven a hot reducing gas mainly consisting of CO and $H_2$. However, it is also possible to supply the plasma oven with an inert gas, if injection of reducing gases is to be stopped. The inlet pipe may be supplied with reducing gas or air (usually hot).

We claim:

1. A method of injecting hot gases into a shaft furnace, comprising:

introducing a flow of gases to a tuyere from each of an inlet pipe and an outlet pipe emanating from a plasma oven, the longitudinal axis of the tuyere and the longitudinal axis of the inlet pipe forming a first angle, which first angle defines a first vector in combination with the mass flow and velocity of gas passing through the inlet pipe, the longitudinal axis of the tuyere and the longitudinal axis of the outlet pipe forming a second angle, which second angle defines a second vector in combination with the mass flow and velocity of gas passing through the outlet pipe, the resultant of the first vector and the second vector providing gas flow parallel to the longitudinal axis of the tuyere.

2. A method of injecting hot gases into a shaft furnace according to claim 1, wherein the second angle is oblique.

3. A device for injecting hot gases into a shaft furnace comprising:

a tuyere;

an inlet pipe communicating with said tuyere and capable of delivering a gas flow thereinto;

a plasma oven communicating with said tuyere by means of an outlet pipe, said outlet pipe capable of delivering a gas flow to said tuyere, each of said inlet pipe and said outlet pipe being arranged at an angle with respect to the longitudinal axis of the tuyere such that the longitudinal axis of the tuyere and the longitudinal axis of the inlet pipe form a first angle, which first angle defines a first vector in combination with the mass flow and the velocity of a gas passing through the inlet pipe and the longitudinal axis of the tuyere and the longitudinal axis of the outlet pipe form a second angle, which second angle defines a second vector in combination with the mass flow and the velocity of a gas passing through the outlet pipe, the resultant of the first vector and the second vector being parallel to the longitudinal axis of the tuyere.

4. The device according to claim 1, wherein the second angle is oblique.

* * * * *